US007584557B1

(12) United States Patent
Nistler

(10) Patent No.: US 7,584,557 B1
(45) Date of Patent: Sep. 8, 2009

(54) SNOW PLOWING SYSTEM

(75) Inventor: Timothy A. Nistler, McGregor, MN (US)

(73) Assignee: Degelman Industries Ltd., Regina, Saskatchewan (CA)

( * ) Notice: Subject to any disclaimer, the term of this patent is extended or adjusted under 35 U.S.C. 154(b) by 0 days.

(21) Appl. No.: 11/149,626

(22) Filed: Jun. 9, 2005

Related U.S. Application Data

(60) Provisional application No. 60/578,793, filed on Jun. 9, 2004.

(51) Int. Cl.
*E01H 5/06* (2006.01)

(52) U.S. Cl. ..... 37/274; 37/281; 37/234

(58) Field of Classification Search ..... 37/264, 37/266, 268, 274, 275, 280, 281, 234; 172/684.5, 172/810, 811, 817, 815; 56/228
See application file for complete search history.

(56) References Cited

U.S. PATENT DOCUMENTS

| | | | | |
|---|---|---|---|---|
| 2,230,704 | A * | 2/1941 | Sorensen | 172/815 |
| 3,027,662 | A * | 4/1962 | Cunningham, Jr. | 172/815 |
| 3,206,879 | A | 9/1965 | Grover | |
| 3,430,706 | A | 3/1969 | Marron | |
| 3,477,151 | A | 11/1969 | Zanella | |
| 3,898,753 | A * | 8/1975 | Kinnunen | 37/273 |
| 4,077,139 | A | 3/1978 | Fagervold et al. | |
| 4,099,578 | A * | 7/1978 | Stevens | 172/815 |
| 4,356,645 | A | 11/1982 | Hine et al. | |
| 4,479,312 | A * | 10/1984 | Turgeon | 37/219 |
| 4,723,609 | A | 2/1988 | Curtis | |
| 4,936,392 | A | 6/1990 | Kitchin | |
| 5,018,284 | A | 5/1991 | Mikami et al. | |
| 5,285,588 | A | 2/1994 | Niemela et al. | |
| 5,411,102 | A * | 5/1995 | Nickels et al. | 172/781 |
| 5,638,618 | A | 6/1997 | Niemela et al. | |
| 5,655,318 | A | 8/1997 | Daniels | |
| 5,758,728 | A | 6/1998 | Ragule | |
| 5,819,444 | A | 10/1998 | Desmarais | |
| 5,829,174 | A | 11/1998 | Hadler et al. | |
| 5,848,654 | A | 12/1998 | Belcher, Jr. | |
| 5,860,230 | A | 1/1999 | Daniels | |
| 5,894,689 | A | 4/1999 | Turk | |
| 6,044,579 | A | 4/2000 | Hadler et al. | |
| 6,154,986 | A | 12/2000 | Hadler et al. | |
| 6,249,992 | B1 | 6/2001 | Irving et al. | |
| 6,408,549 | B1 | 6/2002 | Quenzi et al. | |
| 6,412,199 | B1 | 7/2002 | Quenzi et al. | |
| 6,412,200 | B1 * | 7/2002 | Savard | 37/281 |

(Continued)

*Primary Examiner*—Thomas B Will
*Assistant Examiner*—Jamie L McGowan
(74) *Attorney, Agent, or Firm*—Daniels Patent Law, PLLC; Scott A. Daniels

(57) ABSTRACT

A detachable snow plow blade is driven by a skid-steer or other suitable vehicle. The detachable plow blade has hydraulically adjustable wing blades that each pivot under separate control about a main blade. Pins that support power cylinders between braces are arranged to enable each wing to extend through a range of motion from essentially perpendicular to and ahead of the main blade to essentially perpendicular to and behind the main blade. In a further alternative embodiment, the entire blade, including wing blades, may additionally be pivoted with respect to the vehicle, resulting in a very adjustable blade which is well adapted to emulate prior art box plow/pushers, conventional plows, pull back/drag plows, V-plows and fold-out plows.

12 Claims, 8 Drawing Sheets

U.S. PATENT DOCUMENTS 6,442,877 B1 9/2002 Quenzi et al.
7,134,227 B2 * 11/2006 Quenzi et al. ..... 37/274

2002/0194752 A1 12/2002 Guinard

* cited by examiner

SNOW PLOWING SYSTEM

CROSS REFERENCE TO RELATED APPLICATIONS

This application claims priority to U.S. provisional patent application Ser. No. 60/578,793 filed Jun. 9, 2004 by the present inventor and entitled "Snovantage Snow Plowing System," the contents which are incorporated herein by reference in entirety.

BACKGROUND OF THE INVENTION

1. Field of the Invention

This application pertains generally to the field of excavating, and more particularly to snow or ice removal using scraper blades with auxiliary wings or extensions. In one preferred embodiment, the invention is a snow plow blade having a central section, the central section leading and coupled to a skid-steer, and two pivotal wings extending beyond the skid-steer and central section, both wings which are each separately adjustable through a nearly one hundred and eighty degree arc.

2. Description of the Related Art

Most modern transportation is based upon wheels, which perform much better traveling over clear, dry roadways. In addition to facilitating vehicular travel, the clearing of snow will also facilitate melting and drying in the more temperate regions, which makes for much cleaner, less icy, and safer areas for persons to traverse. While snow is sometimes cleared manually, snow plow blades simplify and greatly accelerate the clearing of snow from a particular area. Plows also reduce the chance of physical over-exertion, which can lead to heart attacks, strokes and death in those with compromised cardiovascular systems. As a result, snow plows have become relatively indispensable in the "snow-belt" regions.

A large number of snow plow blades have been devised in the prior art, most which are supported upon and require movement of a separate machine. Common snow plows are coupled on the front of a vehicle such as an all-terrain vehicle (ATV) or automobile. In the case of the ATV, clearing a light snow in a relatively small space is quite feasible, but such plows are just not suitable for either larger areas or deeper snows. The ATV is not heavy enough nor powerful enough to move substantial snow. In the case of an automobile, a common sight in the "snow belt" is that of a pick-up truck, SUV or four-wheel drive with a large plow coupled to the front. These plows, which comprise the vast majority of smaller commercial snow-removal equipment, may be accompanied at a job site by skid-steers or the like that provide front-end loader capability. The front-end loader complements a plow truck by being able to lift the snow onto taller piles, and in some instances may be used to load snow into snow-hauling dump trucks or the like.

Municipalities frequently employ trucks that are much larger than pick-ups for snow plowing, generally with front-mounted plows in the form of a large and tall blade placed at an angle to the front of the truck. As the truck is driven forward, the snow is then pushed, or in some instances literally rolled and blown, off to the side. Once again, front-end or other types of loaders may be employed where there is not sufficient space to simply leave the snow pushed off to the side.

A common feature that each of the foregoing snow plows have in common is the width of the plow. In each case, the plow is designed to function essentially within the width of a single traffic lane. Said another way, the pickup truck with front-mounted blade must travel over the roadways, typically going from location to location to clear snow. During transit, the plow must fit within the allotted lane of the roadway. Consequently, the vast majority of plows are limited to clearing an approximately eight foot wide pathway. Furthermore, and as aforementioned, these plows are unable to pile the snow beyond a height limited by the height of the blade and weight and traction of the vehicle.

In some cases, road-grading equipment has been used to clear snow. Most road graders have the ability to pivot the blade about a vertical axis, and so the blade may be significantly longer than eight feet, since the blade may be oriented so that the longest dimension of the blade extends nearly parallel to the vehicle longitudinal axis during transit, and may later be pivoted to extend more perpendicular to the vehicle direction of travel for use at a site. However, road graders are very specialized and expensive machines, the price which is beyond most individuals and organizations that are involved in snow clearing and removal. Furthermore, most road graders are designed to carry the blade in the center of the vehicle, beneath the operator. Consequently, it is impossible to accumulate snow at any elevation much higher than the blade. In turn then, there are frequent times when snow must be hauled away which might otherwise simply be piled. If the snow must be hauled, then, in addition to the road grader, there must also be a suitably sized loader and hauler.

Some more recent equipment has included supplemental wings or extensions. In the case of road grading, an adjustable extension may enable the plow to not only grade a roadway, but through the wing extension a shoulder or even a ditch may be plowed. While such extensions are coming into more favor in the road grading industry and occasionally in the case of municipal plows, these extensions have heretofore been applied simply to permit the extension of reach from a traffic lane into a shoulder, ditch or the like. Furthermore, these extensions have offered no little further synergy, other than a larger or wider blade, or, in some cases, the ability to adjust angles to simultaneously address a roadway and a ditch or embankment. Exemplary of the technology, and the contents which are incorporated herein by reference, are the U.S. Pat. Nos. 3,430,706 by Marron, entitled "Slope cutting attachment for bulldozers," which illustrates a wing blade that hydraulically adjusts from perpendicular behind the main blade to a significant angle forward of the main blade; 4,099,578 by Stevens, entitled "Hinged bulldozer blade," which illustrates pivoting wingblades with hydraulic actuation cylinders from the main blade; 4,723,609 by Curtis, entitled "Double bladed combination scraper," which illustrates hydraulic ram actuated side wings; 5,758,728 by Ragule, entitled "Plow with articulating blade," which illustrates a segmented blade pivoted so two segments act together in configuring the wing section; 6,408,549 and 6,412,199 by Quenzi et al, which illustrate wings that pivot forward and have an extension that is hydraulically actuated; 5,285,588 by Niemela et al, entitled "Winged plow," which discloses side gates for a plow blade that pivot from almost perpendicular to the main blade forward to just aft of parallel with the main blade; and 5,638,618 by Niemela et al, entitled "Adjustable wing plow," which discloses wing blades that pivot from parallel to the main blade to forward of the main blade.

As this technology has been novelly adapted to the field of snow plowing, other artisans, as shown by the following patents, the teachings which are further incorporated herein by reference, have further adapted the wings. U.S. Pat. No. 5,819,444 by Desmarais, entitled "Snow blade with tilting lateral panels," shows a pivot of side panels from fully to the rear to forward of parallel with the center blade by hydraulic ram. U.S. Pat. No. 5,829,174, U.S. Pat. No. 6,044,579 and U.S. Pat. No. 6,154,986 by Hadler et al, illustrate a small center blade and two wing blades adjustable forward and aft. U.S. Pat. No. 6,442,877 by Quenzi et al, entitled "Plow with rear mounted, adjustable wing," discloses the general use of winged plow device for snow and other materials. The blade extends and retracts sideways, and pivots forward when extended. U.S. Pat. No. 4,479,312 by Targeon, entitled "Folding snow compactor with side wings pivotal behind central blade," illustrates wings that pivot from stowed behind the main blade to fully extended sideways. U.S. Pat. No. 5,655,318 by Daniels, entitled "Snowplow with pivotal blade end extensions," discloses wings that pivot between extended and stowed, and the blade is detachable from vehicle. U.S. Pat. No. 3,477,151 by Zanella, entitled "Snowplow," illustrates wing blades that pivot from parallel to the main blade to forward positions through hydraulic actuation. Finally, U.S. Pat. No. 4,356,645 by Hine et al, entitled "Variable wing plow blade and mounting structure therefor," illustrates wing blades that pivot forward and aft of parallel with center blade.

A number of other artisans have illustrated related subject matter, the teachings which are additionally incorporated herein by reference, including U.S. Pat. No. 3,206,879 by Grover; U.S. Pat. No. 4,077,139 by Fagervold et al; U.S. Pat. No. 5,018,284 by Mikami et al; U.S. Pat. No. 5,848,654 by Belcher; U.S. Pat. No. 5,860,230 by Daniels; U.S. Pat. No. 6,249,992 by Irving et al; and U.S. published application 2002/0194752 by Guinard.

SUMMARY OF THE INVENTION

In a first manifestation, the invention is a snow plow. The snow plow has a drive vehicle. A central plow section extends longitudinally from a first point to a second point and is coupled to and transported by the drive vehicle. The central plow section has a plow surface. At least one wing extends from the central plow section and pivotally couples thereto through a pivot. The at least one wing has a plow surface, and is pivotal about the central plow section substantially from perpendicular and leading the central plow section to perpendicular and trailing the central plow section. A powered extensible and retractable member is extensible and retractable along an axis of extension and retraction. A first pivotal coupling retains the powered extensible and retractable member to the central plow section adjacent a first end of the powered extensible and retractable member. The first pivotal coupling protrudes from the central plow section in a direction parallel to an axis between the first and second points but is not actually between the first and second points. The first pivotal coupling spaces the powered extensible and retractable member from the central plow section. A second pivotal coupling retains the powered extensible and retractable member to the at least one wing adjacent a second end of the powered extensible and retractable member distal to the first end and spacing the powered extensible and retractable member from the at least one wing plow surface. The second pivotal coupling protrudes from the central plow section and is located between framing members when the at least one wing is perpendicular to and trails the central plow section.

In a second manifestation, the invention is an excavating apparatus for scraping loose matter from a surface. A main blade has a pushing surface adapted to contact the loose matter. A vehicle coupler surface generally parallel to and spaced from the pushing surface terminates at two distally opposed ends at two pin hinges. Two distally opposed tapers have surfaces adjacent the pushing surface sloping from immediately adjacent the pushing surface away therefrom to ones of the pin hinges. A first wing is coupled to a first one of the two pin hinges and is pivotal thereabout. The first wing has a pushing surface, a back surface spaced from the first wing pushing surface, and a taper having a surface sloping from immediately adjacent the first wing pushing surface away therefrom to ones of the pin hinges. A power member is coupled between the main blade and first wing that is operative to pivot the wing and thereby move the first wing taper surface more nearly adjacent the main blade taper surface. The first wing taper surface is spaced less from the main blade taper surface more nearly adjacent a one of the pin hinges.

In a third manifestation, the invention is a snow plow. The snow plow has a main blade, with first and second wings flanking and pivotally coupled to the main blade at first and second main blade-to-wing pivots, respectively. A first power cylinder is coupled to the first wing at a first wing-to-cylinder pivot and coupled to the main blade at a first main blade-to-cylinder pivot. The first power cylinder is retractable to be shorter than a combined minimum distance between the first main blade-to-cylinder pivot and first wing-to-cylinder pivot and extendable to be longer than a maximum distance between first main blade-to-cylinder pivot and first wing-to-cylinder pivot summed with a maximum distance between the first main blade-to-cylinder pivot and the first main blade-to-wing pivot.

OBJECTS OF THE INVENTION

Exemplary embodiments of the present invention solve inadequacies of the prior art by providing a detachable snow plow blade which is useful in combination with a skid-steer or other suitable vehicle. The detachable plow blade has hydraulically adjustable wing blades adjusting separately from extending essentially perpendicular to and ahead of the main blade to essentially perpendicular to and behind the main blade. In a further alternative embodiment, the entire blade, including wing blades, may additionally be pivoted with respect to the vehicle, resulting in a very adjustable blade which is well adapted to a variety of uses and applications beyond those achievable heretofore in the prior art.

A first object of the invention is to only require nominal finished weight, while still being structurally engineered for strength and durability. A second object of the invention is to provide plows in different heights and widths, including widths which may be either substantially greater than the width of a traffic lane, such as, for exemplary purpose, 16, 18 and 20 foot widths, or narrower, as may be desired. Another object of the present invention is to enable the snow plowing system which achieves the foregoing objects to be easily loaded on a standard skid-steer trailer, without detachment from the skid steer and which may be transported through spaces of approximately the size of standard motive vehicles and within a single standard traffic lane. A further object of the invention is to provide snow plowing blades that are fully functional no matter what relative position they are in, thereby enabling the functions provided by a prior art box plow/pusher, conventional plow, pull back/drag, V-plow and a fold-out. Yet another object of the present invention is to enable plow wings, when in the most forward position, to glide effortlessly over sidewalks and curbs, minimizing both surface damage and the possibility of damage to the motive machine or the present inventive snow plowing system.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
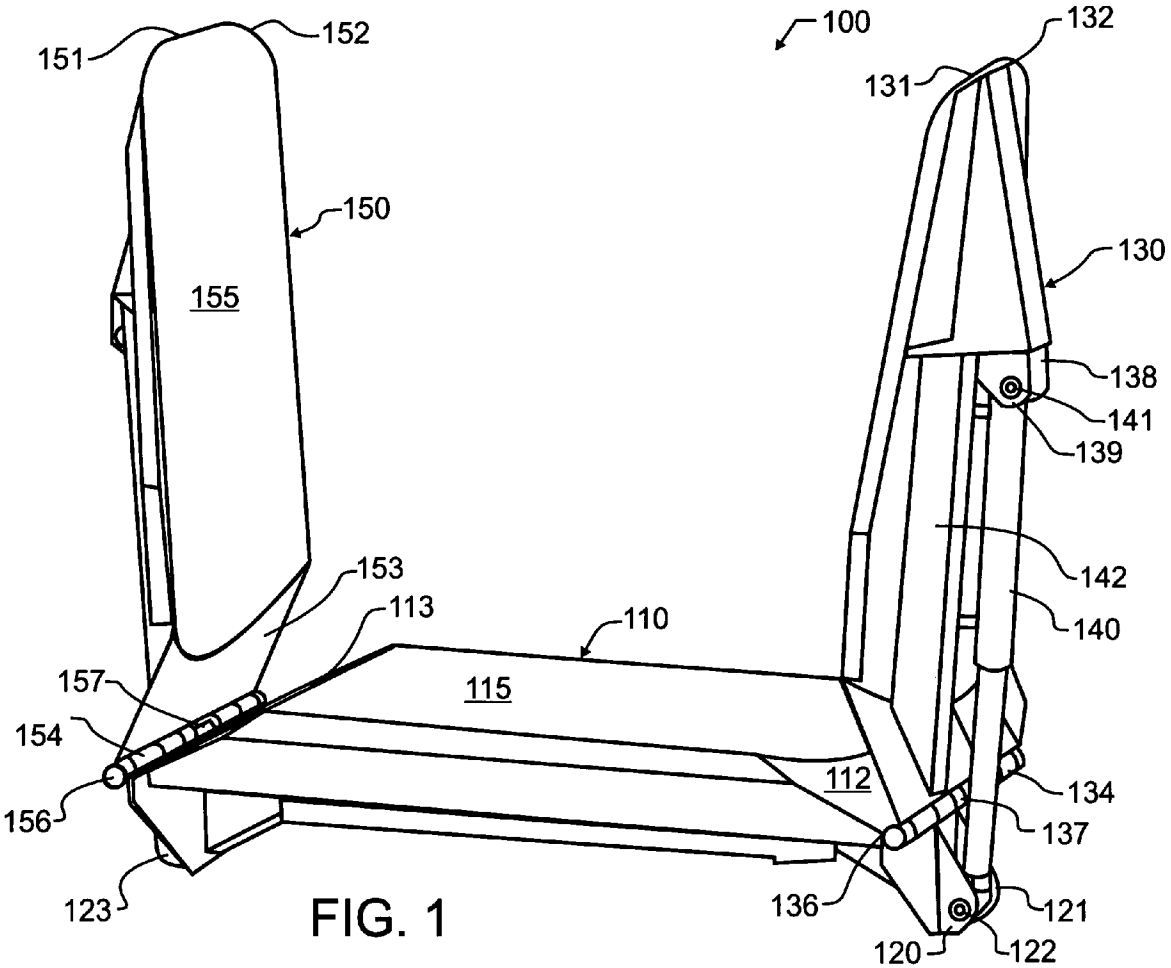
FIG. 1 illustrates a preferred embodiment snow plowing system designed in accord with the teachings of the invention from a projected plan view, with the left and right wings extending generally perpendicularly from and leading the center section.
Figure 2:
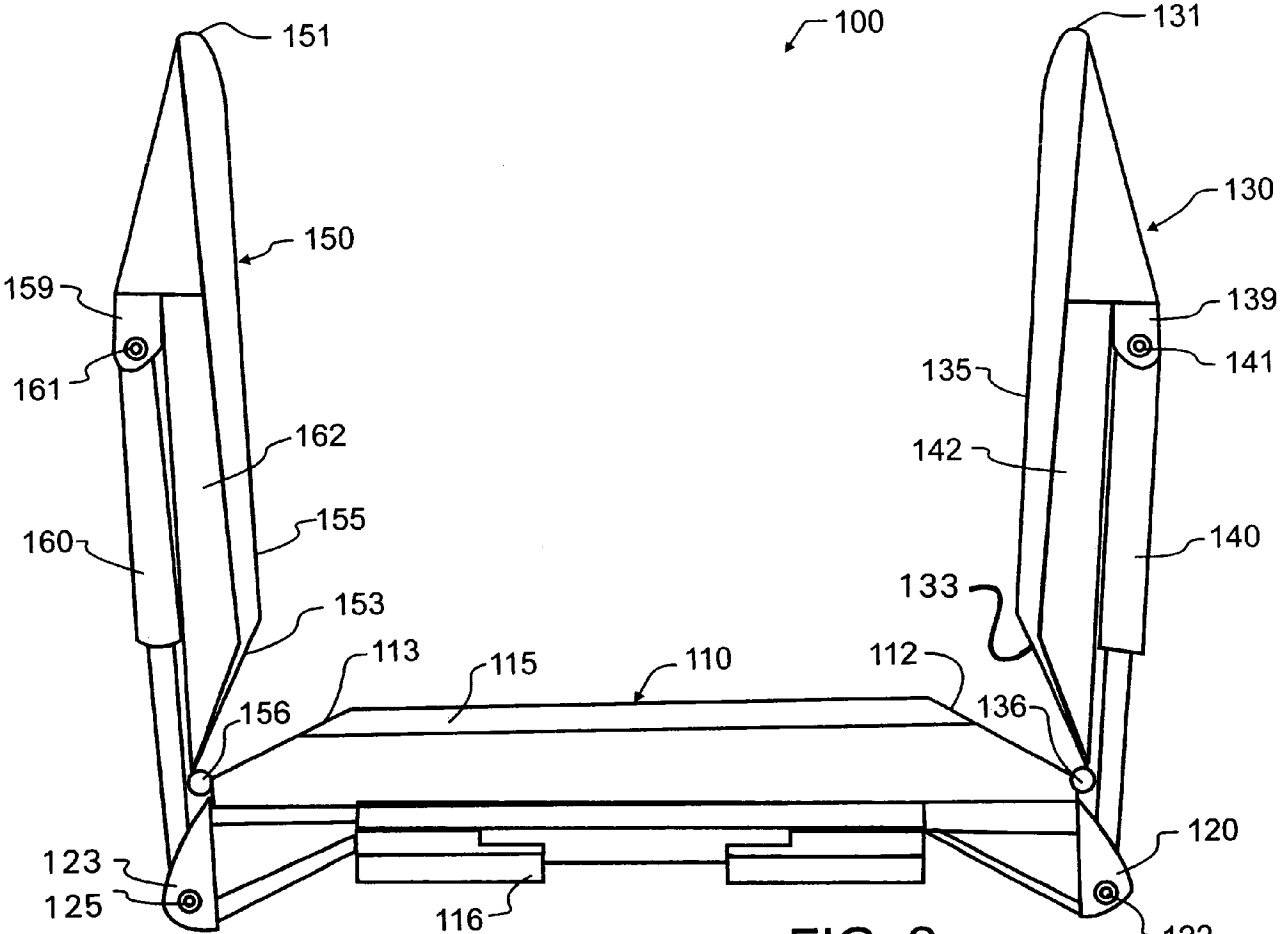
FIG. 2 illustrates the preferred embodiment snow plowing system of FIG. 1 from a top plan view.
Figure 3:
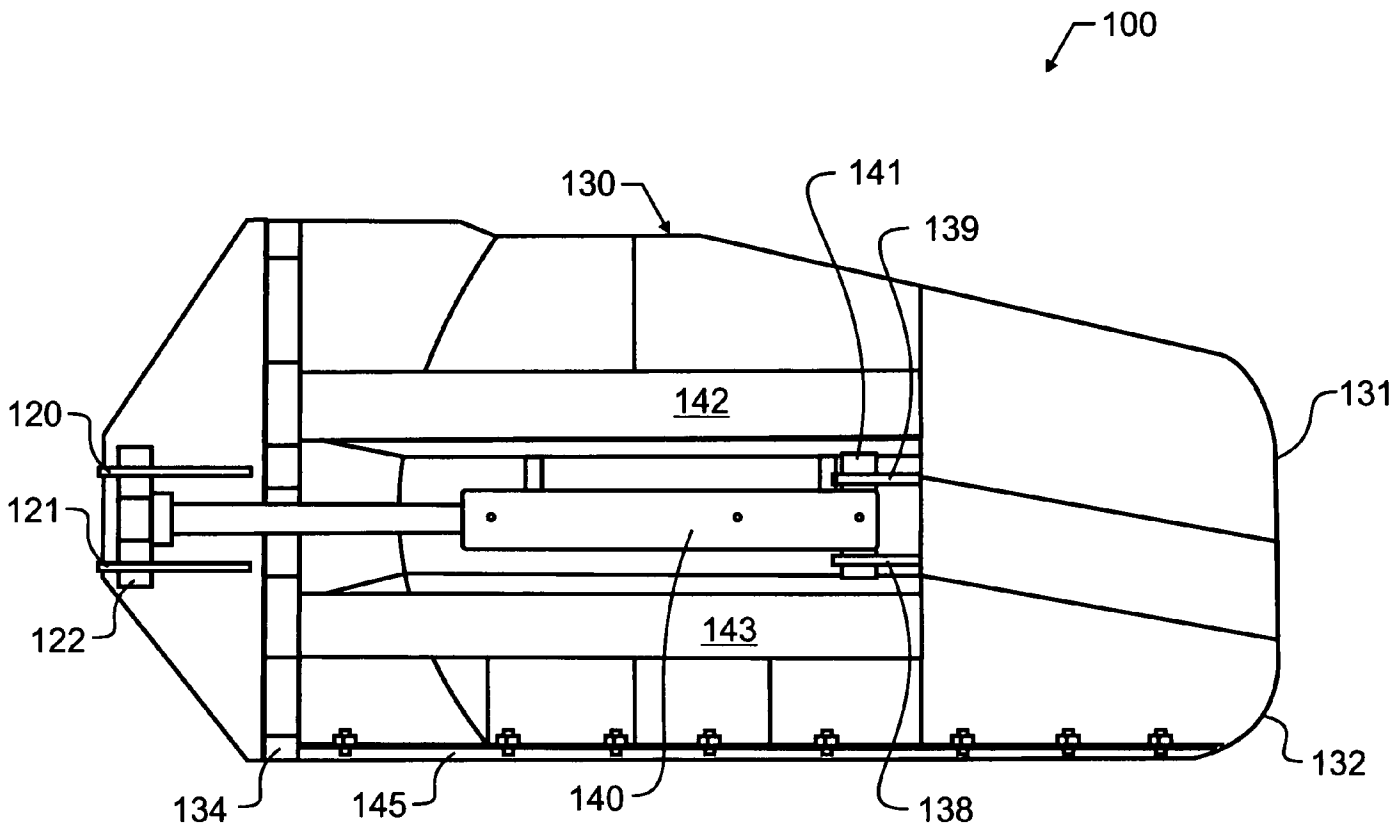
FIG. 3 illustrates the preferred embodiment snow plowing system of FIG. 1 from a side plan view.

Manifested in the preferred embodiment, the present invention provides a snow plowing system 100 which comprises three main sections. A main blade 110 is flanked on opposite ends by right wing 130 and left wing 150. FIGS. 1-3 illustrate preferred embodiment snow plowing system 100 having right and left wings 130, 150 extending generally perpendicularly from and leading centrally located main blade 110. For the purposes of the present disclosure, the words leading and trailing will be understood to be assumed for a direction of typical forward travel by a vehicle coupled as shown for exemplary purposes in FIG. 10, wherein such a vehicle would normally travel in a forward direction from the back side of main blade 110, adjacent coupling 116, and will be urging against coupling 116 towards surface 115. Nevertheless, one of the features and benefits of the preferred embodiment is the ability to push or pull. Consequently, the words leading and trailing are simply for the purposes of illustration, and are not limiting to the operational capabilities of the invention.

Main blade 110 has a plowing face 115 which will serve to move snow forward when snow plowing system 100 is being driven forward. In this forward direction of travel, snow will be trapped between plowing faces 135 and 155 as well, and in fact may even be compacted therebetween if right and left wings 130, 150 are urged towards each other. This is accomplished by extending one or both of power cylinders 140, 160, the operation which will be described further herein below. As the power cylinders are extending, they will in turn urge the associated wing to pivot about hinge pins 136, 156, which in turn reduces the distances between wing tip 131 and wing tip 151. As this distance between wing tips 131, 151 decreases, any snow held therein will either be displaced or compacted, depending upon how much snow is therebetween, the characteristics of the snow, and other similar factors.

With wings 130, 150 leading main blade 110, as illustrated in FIGS. 1-3, wing tips 131, 151 will be the first points of contact with any obstacles that might commonly be encountered, such as curbs, parking curbs, sidewalk, and other such obstacles. Wing tips 131, 151 have been rounded on the lower side thereof into curved surfaces 132, 152, which are preferably designed to much more readily raise up over any obstacles that might be encountered. By raising, rather than binding, curbs and other obstacles are protected from damaging contact during typical plowing operations. Furthermore, when an obstacle is unexpectedly encountered while traveling forward at greater speeds, this gentle rounding of curved surfaces 132, 152 will also help to protect both snow plowing system 100 and a driving vehicle from potentially damaging impacts.

In preferred embodiment snow plowing system 100, wings 130 and 150 are able to pivot about hinge pins 136,156, respectively, each approximating a full one-hundred and eighty degrees of rotation. This unusually large range of motion is provided by the novel arrangements illustrated herein. More particularly, cylinder 140 is coupled at a first end to pin 122, and is free to pivot thereabout. However, cylinder 140 is otherwise restrained between top bracket 120 and bottom bracket 121. Likewise, distal to pin 122 is pin 141, which serves a like function to pin 122. Cylinder 140 is similarly coupled thereto and free to rotate there about. Restraining cylinder 140 vertically adjacent pin 141 are top bracket 139 and bottom bracket 138. As cylinder 140 is extended, tip 131 will be pivoted closer to tip 151. Limiting the extent of forward rotation is the potential interference between cylinder 140 and hinge 134. To allow greater movement before such interference occurs, hinge 134 is absent in a small void 137 adjacent cylinder 140. Consequently, the first interference with cylinder 140, as cylinder 140 is extended, will in the preferred embodiment occur between cylinder 140 and hinge pin 136. Rather than allow such interference, cylinder 140 will most preferably stop at a point of maximum travel just prior to interfering with hinge pin 136. Like construction and operation, only in mirror image, exists with cylinder 160, pins 125, 161, upper bracket 123, lower bracket, pin 125, hinge body 154, small void 157, upper bracket 159, lower bracket 158, and pin 161.

If wings 130, 150 terminated in a rectangular end adjacent main blade 110, when viewed from a top view as in FIG. 2, there would also be interference to rotation between these rectangular ends. Such interference is known in the prior art. However, in the present invention, plowing faces 135, 155 end with angled tapers 133, 153 adjacent hinges 134, 154, respectively. These angled tapers cooperate with similar tapers 112, 113 on main blade 110, adjacent plowing face 115. Consequently, when in the forward position illustrated in FIG. 1, there is no pinching occurring between wings 130, 150 and main blade 110. Instead, there are preferably small gaps between angled tapers 113 and 153, and also between angled tapers 112 and 133. These gaps allow ice and snow to be expelled, rather than trapped, when wings 130, 150 are pivoted. Further, there is no chance for ice to be formed between wings 130, 150 and main blade 110 which would prevent relative motion therebetween.

As best viewed in FIG. 3, upper bracket 120 is slightly below wing upper brace 142. Lower bracket 121 is just slightly higher than wing lower brace 143. This relative placement is critical to the proper performance of this hinge, as will be further explained with regard to FIGS. 6 and 7.

Figure 4:
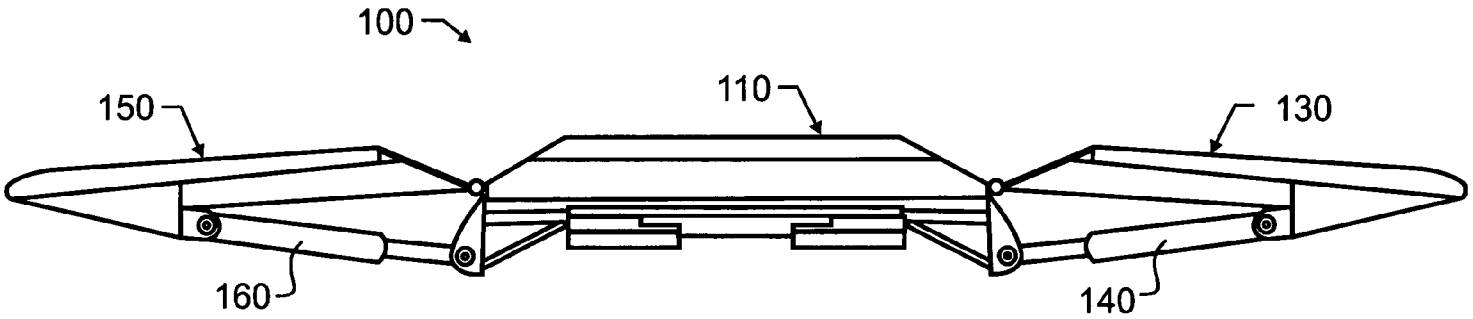
FIG. 4 illustrates the preferred embodiment snow plowing system of FIG. 1 from a top plan view, with the left and right wings extending generally parallel to the center section.
Figure 5:
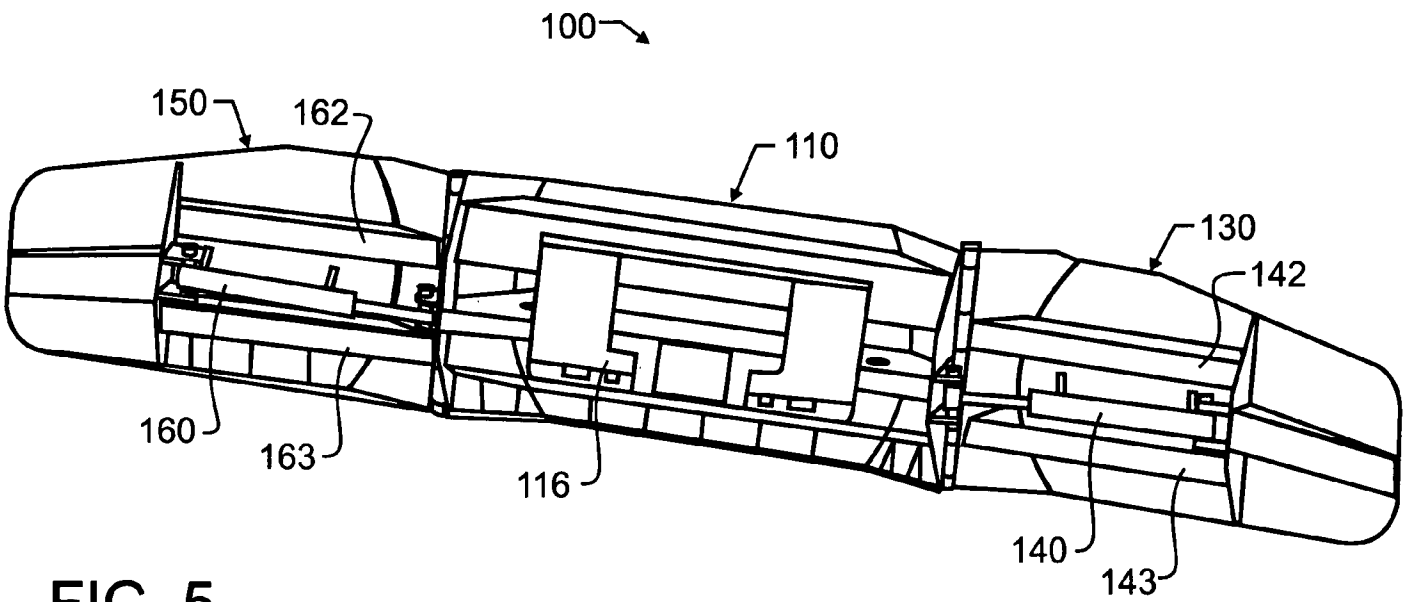
FIG. 5 illustrates the preferred embodiment snow plowing system of FIG. 4 from a rear and slightly projected view.

FIGS. 4 and 5 illustrate the preferred embodiment snow plowing system 100 of FIG. 1 from a top plan view, with the left and right wings extending generally parallel to the center section. This placement of wings 130, 150 relative to main blade 110 is intermediate in rotation. Since in this position wings 130, 150 extend longitudinally with main blade 110, this will also present the greatest plowing width. Single plow blades of the prior art are limited in width to the width of main blade 110, which is in turn limited to the width of a roadway traffic lane. As is apparent, the present invention effectively plows a width far greater, limited only by the motive strength of the vehicle, the strength of each hydraulic cylinder 140, 160, and the materials used in the fabrication of wings 130, 150 and wing upper and lower braces 142, 143, 162, 163.

Figure 6:
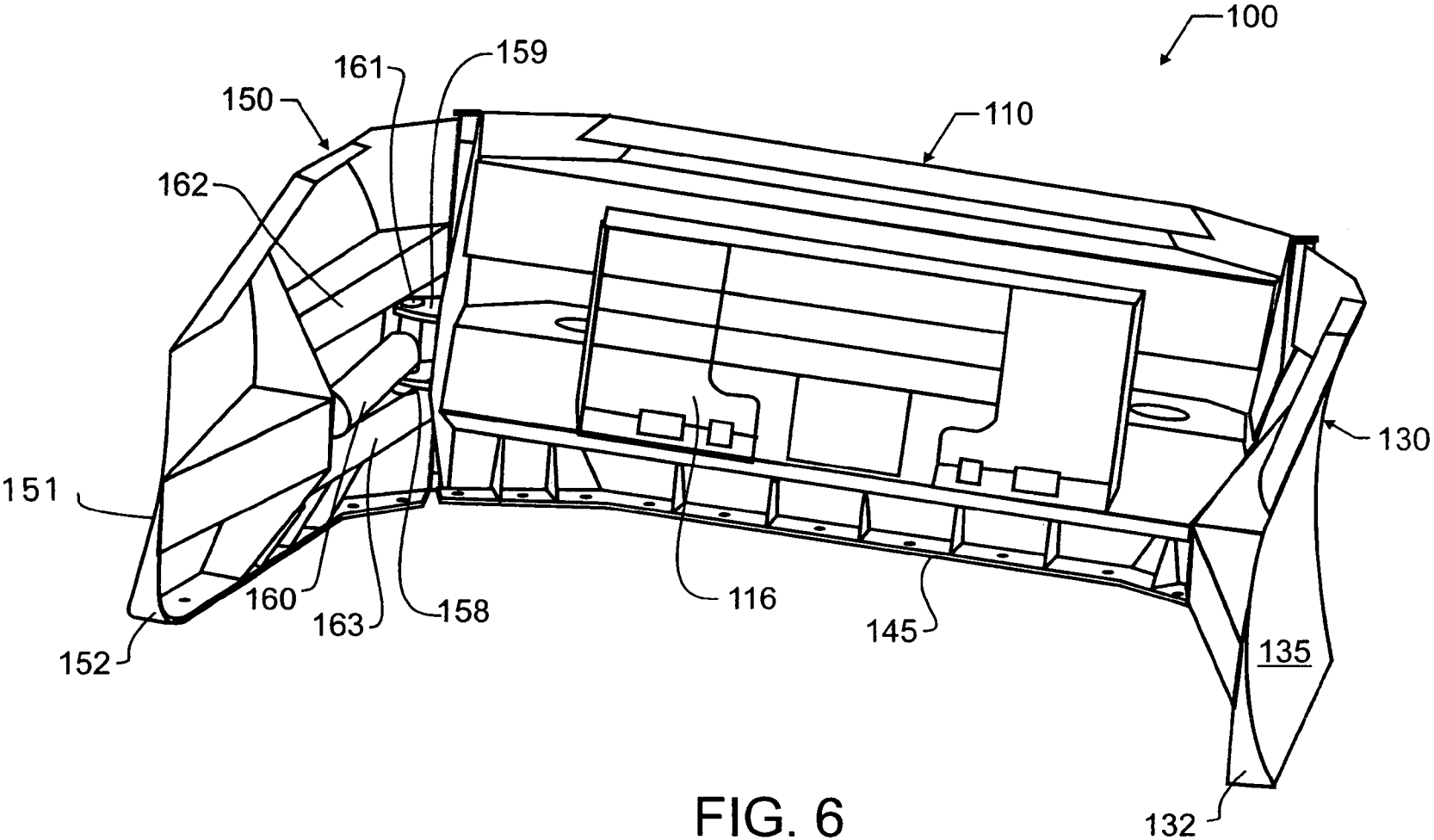
FIG. 6 illustrates the preferred embodiment snow plowing system of FIG. 1 from a projected plan view, with the left and right wings extending generally perpendicularly from and trailing the center section.
Figure 7:
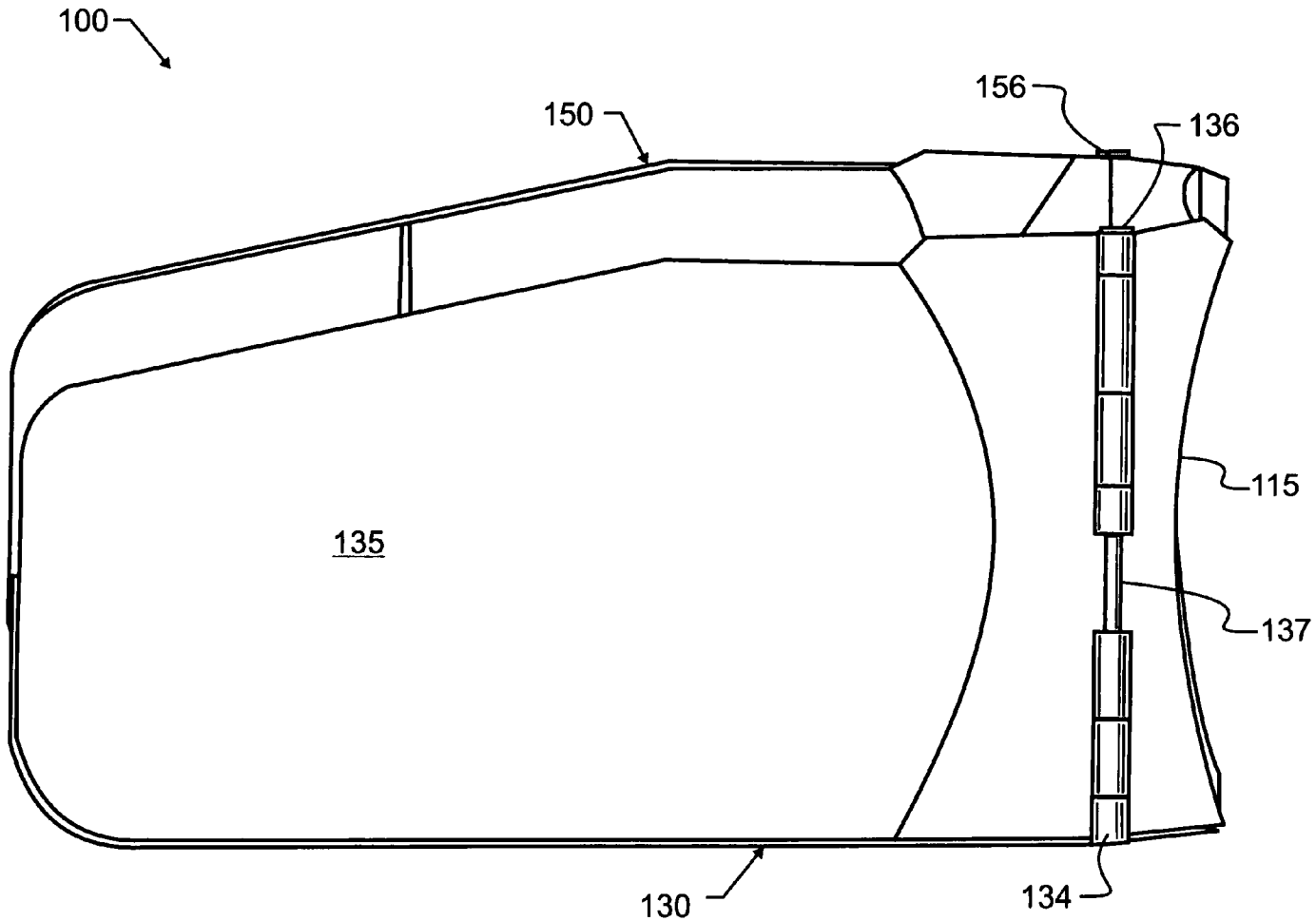
FIG. 7 illustrates the preferred embodiment snow plowing system of FIG. 6 from a side and slightly projected view.

FIGS. 6 and 7 illustrate the preferred embodiment snow plowing system 100 of FIG. 1, with the left and right wings extending generally perpendicularly from and trailing the center section. Most visible in FIG. 6 is the placement of top bracket 159, bottom bracket 158, and pin 161. As may be seen, brackets 158, 159 and pin 161 all fit within a space between upper brace 162 and lower brace 163. Furthermore, as can be seen comparing FIGS. 2 and 6, cylinder 160 is significantly shorter as shown in FIG. 6 than in FIG. 2. In fact, viewing FIG. 2, cylinder 160 is an amount shorter which is approximately equal to twice the distance between pin 125 and hinge pin 156. This is because the distance between hinge pin 156 and pin 161 is essential constant, irrespective of the position of wing 150. However, in the position of FIG. 2, cylinder 160 has to traverse not only the distance between hinge pin 156 and pin 161, it must also traverse approximately the distance between hinge pin 156 and pin 125. When in the position illustrated in FIG. 6, cylinder 160 is traversing the distance from pin 161 to hinge pin 156, less the distance from hinge pin 125 to hinge pin 156. Consequently, assuming that cylinder 160 is a double acting cylinder which can be driven to both extend and retract, driving cylinder 160 to extend will cause wing 150 to rotate towards the forward-most position illustrated in FIG. 2. Retracting cylinder 160 will cause wing 150 to rotate towards the rearward position illustrated in FIG. 6. Consequently, cylinder 160 can be used to drive wing 150 through an approximately one-hundred and eighty degrees of rotation. In practice, a slightly smaller amount of rotation is desired to ensure that with plow loads, manufacturing tolerances, and other similar factors there is no chance of either wing 130 or wing 150 from ever passing beyond the one-hundred and eighty degree point. Consequently, an approximately one-hundred and sixty-five degrees of rotation is most preferred.

FIG. 7 shows very clearly the small void 137 in hinge 134, which presents a space within which cylinder 140 may safely pass without interference. In addition, from this figure the preferred curvature of plow face 115 is illustrated. Similar curvatures are most preferably used for plow faces 135, 155, though each of these plow faces will have curvatures or shapes that are most suited for their function and application. In other words, these plow faces 115, 135, 155 may be provided with compound surfaces or compound curvatures as desired at the time of design by an artisan.

While very little discussion has been provided herein above with regard to vehicle coupling 116, it will be understood that a relatively universal coupling may be provided which will couple directly to a large number of prior art vehicles. In the preferred embodiment, coupling 116 is in fact such a coupling, designed for coupling to a large number of skid-steers and like vehicles. Nevertheless, any suitable type of coupling may be used, and the type selected will be dependent upon the vehicle to which the invention is coupled as well as the ultimate dimensions ofboth vehicle and embodiment of the invention. Similarly, readily replaceable wear strips such as wear strip 145 may be provided, which will extend the useful life of snow plowing system 100.

Figure 8:
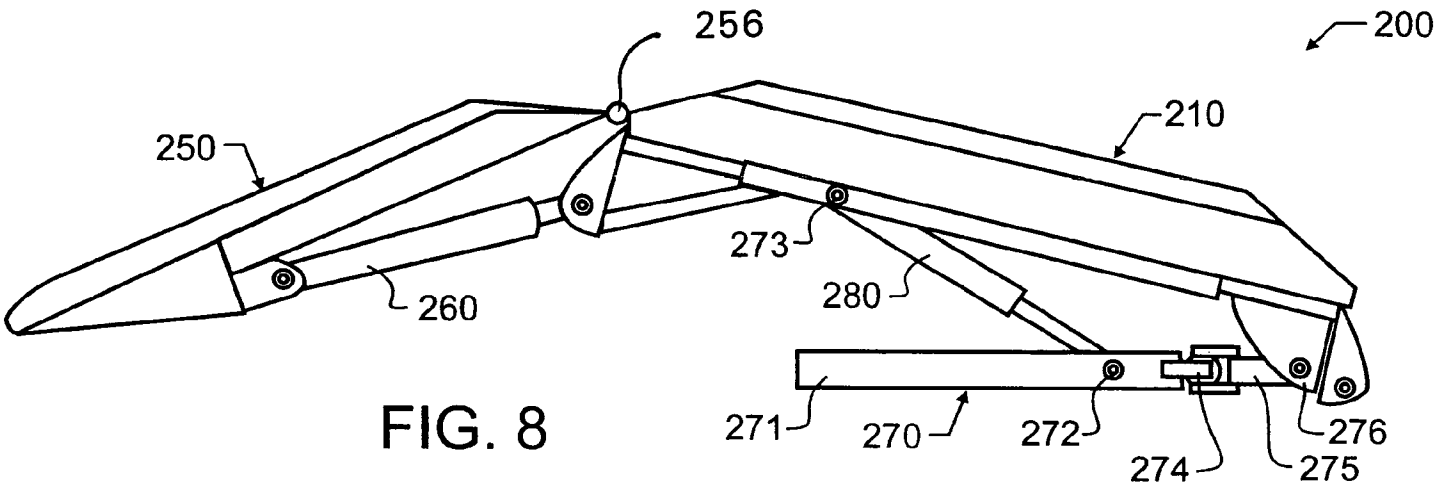
FIG. 8 illustrates a first alternative embodiment snow plowing system designed in accord with the teachings of the invention from a top plan view, and with the right wing removed therefrom for illustrative purposes.
Figure 9:
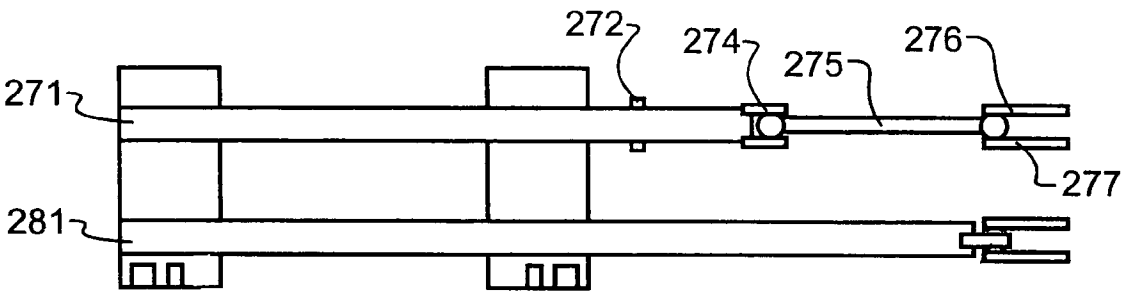
FIG. 9 illustrates a connecting linkage utilized in the first alternative embodiment snow plowing system of FIG. 8 from a projected rear plan view, with the balance of the snow plowing system removed for illustrative purposes.

FIG. 8 illustrates a first alternative embodiment snow plowing system 200 designed in accord with the teachings of the invention from a top plan view, and with the right wing removed therefrom for illustrative purposes. Where functionally identical or similar components are illustrated, numbering has been preserved to so designate, by using like ones and tens digits. So, for example, power cylinder 260 of snow plowing system 200 is functionally equivalent to power cylinder 160 of snow plowing system 100. Where such similarity exists, a minimal amount, if any, further description will be provided with regard to this first alternative embodiment.

Snow plowing system 200 is provided with a special vehicle coupling 270 which is designed to enable an operator to change the orientation of main blade 210 relative to the direction of travel. While support 271 will normally be rigidly coupled to the vehicle, power cylinder 280 may be extended to cause main blade 210 to be at angle relative to support 271, and consequently at some angle other than perpendicular with respect to the direction of forward travel.

The specific components of special vehicle coupling 270 include supports 271,281, coupling pins 272, 273 for coupling power cylinder 280 at distal ends, three flexible or universal-style joints 274, 276, and 277, and a short linkage 275. Linkage 275 is most preferably included, since this allows main blade 210 to swivel forward and backward to limited degree, in the event troublesome obstacles are encountered during plowing.

Figure 10:
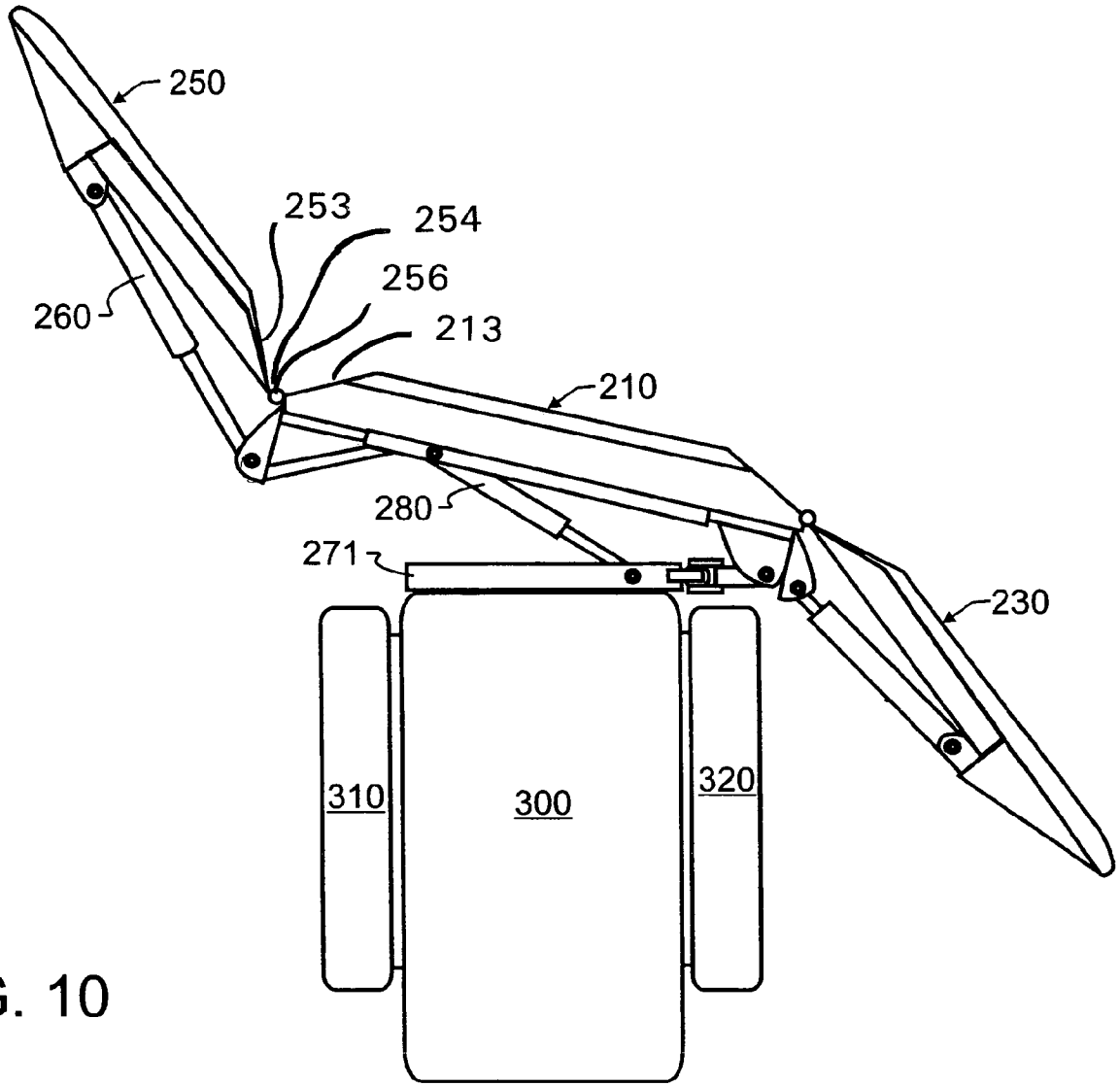
FIG. 10 illustrates the first alternative embodiment snow plowing system of FIG. 8 from a top plan view, in combination with an exemplary land vehicle and in further combination with a cylinder for pivoting the main blade relative to the motive vehicle, with the left wing forward of the main blade, the right wing trailing the main blade, and the main blade offset from perpendicular to the direction of travel of the land vehicle.

FIG. 10 illustrates the first alternative embodiment snow plowing system 200 in combination with an exemplary land vehicle 300 having drive tracks 310,320. As illustrated, power cylinder 280 for pivoting the main blade relative to the motive vehicle is slightly extended, the left wing is forward of the main blade, the right wing is trailing the main blade, and the main blade is offset from perpendicular to the direction of travel of the land vehicle. This arrangement is but one of a myriad of possible configurations. For exemplary purposes only, and not limited thereto, an operator might extend power cylinder 280 sufficiently far that hinge pin 256 is more nearly in front of vehicle 300. If wing 250 is then dropped back to trail hinge 254, and wing 230 is extended parallel to main blade 210, the resulting configuration is that of a "V" plow, with tapered edges 213, 253 and hinge 254 leading during plowing.

As may be apparent from the illustrations, the particular motive vehicle used is not critical to the invention. Nor is the type of drive. Consequently, tracked or wheeled vehicles may be used. The most preferred embodiment is fully welded, finished with a multi-color powder coating and is provided with replaceable cutting edges such as edge 145 illustrated in FIG. 3. While dimensions are not critical to the performance of the present invention, and instead are provided solely as a point of reference, the preferred embodiment moldboard is 32" high and may, for example, be provided in different heights or widths, such as 16, 18 and 20 foot widths. A standard width vehicle for operation within a traffic lane is limited to approximately 8 feet.

Most preferably, a preferred snow plow system designed in accord with the present invention may be set with the wings either leading or trailing, permitting the preferred snow plowing system to be easily loaded on a standard skid-steer trailer without detachment from the skid steer. The wings may be positioned as shown in either FIG. 3 or FIG. 7 to permit passage through spaces only a few inches wider than motive vehicle 300.

As should also be apparent, the snow plowing system blades are fully functional no matter what position they are in. In other words, each of the figures represent operable positions. In the preferred embodiment, wing blades 130, 150 are pivotally attached to main blade 110. Power cylinders, such as but not limited to hydraulic cylinders, are mounted and attached to create motion between the wings and center section through a wide range, preferably meeting or exceeding a 165 degree operating range. This range is illustrated in the contrast between FIGS. 3 and 7.

Snow plowing system blades designed in accord with the preferred embodiments of the invention are fully functional no matter what position they are in. As a result of the range of motion of the wings provided by the disclosed mechanical coupling, the preferred snow plowing system has the features of a box plow/pusher, conventional plow, pull back/drag, V-plow and a fold-out. The unique box plow/pusher and conventional plow position permits an operator to clear parking lots many times faster than a conventional plow. Bringing the side blades forward permits the operator to capture and compact large amounts of snow. Consequently, the operator may then push snow for long distances and place the snow as high as the motive machine can reach. Back-dragging of loading docks, parking lots and driveways are very much simplified over the prior art. Maneuverability of the blades gives the operator greater visibility, permitting the present snow plowing system to be used to clear snow and debris within inches of curbs, building fronts, sidewalks, vehicles, aircraft, utility poles and other obstacles. An operator may navigate around the obstacle in a single continuous motion, simply by moving the adjacent wing to a more forward position while proceeding forward, passing the obstacle, extending the wing back to parallel, and continuing. When the wings are folded back, the operator may, for exemplary purposes, plow a driveway in one pass. Most preferably for this example, the total plow width is sized to exceed the width of the driveway. In this case, the trailing wings ensure that the present snow plowing system moves snow deeper into ditches and off the roadway. Finally, the present snow plowing blades maximize visibility available to an operator.

The preferred wear edge 145 visible in FIG. 3 is uniquely positioned and has more wear surface on the ground, thereby creating less pressure on the wear edge, in turn reducing wear and friction and thereby enabling the snow plowing system to be larger for a given skid-steer. With proper design, preferred wear edge 145 and geometries illustrated herein will slide smoothly across pavement and grass, and eliminate need for plow shoes.

As discussed herein above, the motive vehicle is not limited to one or another type of vehicle, and the preferred embodiment will perform well with both rubber tire and track vehicles. Additionally, while the preferred embodiment uses hydraulic cylinders, it will be recognized by those reasonably familiar with the art that other devices may be used to position the wings and center section, and may include various apparatus and power sources.

From these figure, several additional features and options become more apparent. First of all, the snow plowing system may be manufactured from a variety of materials, including metals, resins and plastics, ceramics or cementitious materials, or even combinations of the above. The specific material used may vary, though special benefits are attainable if several important factors are taken into consideration. Firstly, the snow plowing system will preferably be simply attached to a variety of suitable machines or equipment capable of providing motive power. Most preferably, the preferred snow plowing system will also be weather resistant and sufficiently durable to withstand the vagaries of extreme temperatures, preferably to include both hot and cold, while enduring any forces that may be applied that could tend to fracture or shear the various components. Additionally, resistance to abrasion or seizing from aggregate, ice, sticks and posts, and other various objects that may be encountered will generally be preferable. The actual engagement between the snow plowing system and motive vehicle is, as already noted, dependent upon the motive vehicle and application but will preferably accommodate as many different vehicle couplings as may be possible.

The most preferred material for the structural components of the snow plowing system is powder coated steel. Other materials or ingredients may be provided to enhance the abrasion resistance, weather resistance, and other properties of the coating and resulting product. A variety of designs have been contemplated for the snow plowing system. The tapers illustrated herein are most preferred, but those skilled in the art will recognize upon suggestion that other geometries may be designed or incorporated. Furthermore, where desired, ornamentation may additionally be provided. The materials used for a particular design may be chosen not only based upon the aforementioned factors such as weather resistance and weight, but may also factor in the particular design. Other variations are also contemplated herein with regard to alternative embodiments, such as the use of a single wing, or any of a myriad of other possible alternatives. Furthermore, while the present invention is most suited for the plowing of snow, the moving or handling of other materials is contemplated herein.

Therefore, while the foregoing details what is felt to be the preferred embodiment of the invention, no material limitations to the scope of the claimed invention are intended. The variants that would be possible from a reading of the present disclosure are too many in number for individual listings herein, though they are understood to be included in the present invention. Further, features and design alternatives that would be obvious to one of ordinary skill in the art are considered to be incorporated herein. The scope of the invention is set forth and particularly described in the claims herein below.

I claim:

1. An excavating apparatus for scraping loose matter from a surface, comprising:

a main blade having a pushing surface adapted to contact said loose matter, a vehicle coupler surface generally parallel to and spaced from said pushing surface terminating at two distally opposed ends at two pin hinges, and two distally opposed taper surfaces, each sloping away from said pushing surface towards a respective one of said pin hinges and attached along a complete length of the pin hinges;

a first wing coupled to a first one of said two pin hinges and pivotal thereabout, wherein a portion of said first one of said pin hinges is absent and defines a void to facilitate extension of a powered extensible and retractable member rotating said first wing about the first pin hinge; and a first position defined by the passage of the powered extensible and retractable member into the void without interference with the first pin hinge to move said first wing into a substantially perpendicular position forward of the main blade and the power member.

2. The excavating apparatus of claim 1 wherein a first end of the powered extensible and retractable member is connected to the main blade by a single main blade pivot point and a second end of the extensible and retractable member is connected to the first wing blade at a single wing blade pivot point.

3. The excavating apparatus of claim 1 further comprising:

a second wing coupled to a second one of said two pin hinges and pivotal thereabout, having a pushing surface, a back surface spaced from said second wing pushing surface, and a taper surface sloping away from said second wing pushing surface towards said respective one of said pin hinges.

4. The materials moving blade as set forth in claim 1 wherein said pin hinges comprise a hinge pin extending through a passage defined by a hinge body and the void is formed in an intermediate portion of the hinge body to permit the passage of a power cylinder in a first position wherein the first wing is substantially perpendicularly oriented forward of the main blade.

5. A materials moving blade, comprising:

a main blade;

a first and second wing blades flanking and pivotally coupled to said main blade at respective first and second main blade-to-wing hinges;

a first power cylinder coupled between said first wing and said main blade and a second power cylinder coupled between said second wing and said main blade to facilitate substantially 180 degree pivoting movement between the first and second wing blades and the main blade, a first position wherein at least one of the first and second wing blades is substantially perpendicularly oriented forward of the main blade and a second position wherein at least one of the first and second wing blades is substantially perpendicular oriented rearward of the main blade; and wherein said first and second main blade-to-wing hinges have a portion of the hinge which is absent and defines a space into which said first and second power cylinder may pass without interference to move said first and second wings into a substantially perpendicular position forward of the main blade.

6. The materials moving blade as set forth in claim 5 wherein the main blade includes a main blade materials moving surface defined between a first and second wing supporting ends and having a predetermined height, each of the supporting ends comprising a main blade hinge surface sloping at an acute angle from the main blade materials moving surface to the respective first and second main blade-to-wing hinges along substantially the complete predetermined height of the main blade materials moving surface.

7. The materials moving blade as set forth in claim 6 wherein the sloping main blade hinge surfaces and the sloping wing blade hinge surfaces extend entirely along a length of the first and second main blade-to-wing hinges.

8. The materials moving blade as set forth in claim 5 wherein said main blade-to-wing hinges comprise a hinge pin extending through a passage defined by a hinge body and the space is formed in the hinge body to permit the passage of a portion of the power cylinder in the first position wherein at least one of the first and second wing blades is substantially perpendicularly oriented forward of the main blade.

9. The materials moving blade as set forth in claim 8 wherein the space in the hinge body of each of the main blade-to-wing hinges intersects with an axis of travel defined by the respective first and second power cylinders pivoting the first and second wing blades relative to the main blade.

10. A snow plow comprising, in combination:

a drive vehicle;

a central plow section extending longitudinally from a first point to a second point and coupled to and transported by said drive vehicle and having a plow surface;

at least one wing extending from said central plow section and pivotally coupled thereto along a pivot axis, said at least one wing having a plow surface, and said at least one wing being pivotal about said central plow section substantially from perpendicular and leading said central plow section to perpendicular and trailing said central plow section;

a powered extensible and retractable member extensible and retractable along an axis of extension and retraction;

a first single pivotal coupling directly coupling said powered extensible and retractable member to said central plow section adjacent a first end of said powered extensible and retractable member, a second single pivotal coupling directly coupling said powered extensible and retractable member to said at least one wing adjacent a second end of said powered extensible and retractable member; and said pivot axis comprises a hinge wherein a portion of the hinge is absent and defines a void into which said powered extensible and retractable member may pass without interference with the hinge to move said wing through nearly 180 degrees of movement.

11. The snow plow of claim 10 further comprising a second wing distal to said at least one wing, said second wing pivotal about said central plow section substantially from perpendicular and leading said central plow section to perpendicular and trailing said central plow section.

12. The snow plow as set forth in claim 10 wherein said pivot axis comprises a hinge pin extending through a passage defined by a hinge body and a void is formed in the hinge body and aligned with the axis of extension and retraction to permit the passage of said powered extensible and retractable member in a first position wherein the wing is substantially perpendicularly oriented forward of the central plow section.

* * * * *

UNITED STATES PATENT AND TRADEMARK OFFICE

CERTIFICATE OF CORRECTION

PATENT NO. : 7,584,557 B1
APPLICATION NO. : 11/149626
DATED : September 8, 2009
INVENTOR(S) : Timothy A. Nistler It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 57 days.

Signed and Sealed this

Fourteenth Day of September, 2010

David J. Kappos

David J. Kappos
*Director of the United States Patent and Trademark Office*